US008997616B2

(12) United States Patent
Totani

(10) Patent No.: US 8,997,616 B2
(45) Date of Patent: Apr. 7, 2015

(54) PLASTIC BAG MAKING APPARATUS

(75) Inventor: Mikio Totani, Kyoto (JP)

(73) Assignee: Totani Corporation, Kyoto (JP)

( * ) Notice: Subject to any disclaimer, the term of this patent is extended or adjusted under 35 U.S.C. 154(b) by 180 days.

(21) Appl. No.: 13/699,070

(22) PCT Filed: May 24, 2011

(86) PCT No.: PCT/JP2011/061871

§ 371 (c)(1),
(2), (4) Date: Dec. 27, 2012

(87) PCT Pub. No.: WO2011/148942

PCT Pub. Date: Dec. 1, 2011

(65) Prior Publication Data

US 2013/0092000 A1 Apr. 18, 2013

(30) Foreign Application Priority Data

May 25, 2010 (JP) ..... 2010-119541

(51) Int. Cl.

| | |
|---|---|
| ***B26D 1/00*** | (2006.01) |
| ***B65H 35/06*** | (2006.01) |
| ***B31B 1/00*** | (2006.01) |
| ***B26D 1/03*** | (2006.01) |

(52) U.S. Cl.
CPC *B65H 35/06* (2013.01); *B31B 1/00* (2013.01); *B31B 2219/145* (2013.01); *B31B 2219/148* (2013.01); *B26D 1/035* (2013.01)

(58) Field of Classification Search
CPC ..... B65H 35/06; B26D 1/035; B31B 1/00; B31B 2219/148; B31B 2219/145
USPC ..... 83/202, 203, 42, 39, 56, 649, 846, 563
See application file for complete search history.

(56) References Cited

U.S. PATENT DOCUMENTS

| | | | | | |
|---|---|---|---|---|---|
| 1,558,156 | A | * | 10/1925 | Ford | 101/3.1 |
| 2,710,060 | A | * | 6/1955 | Birkmann | 83/649 |
| 3,144,216 | A | * | 8/1964 | Billingsley | 242/525.3 |
| 3,566,734 | A | * | 3/1971 | Robinson | 83/339 |
| 3,744,384 | A | * | 7/1973 | Jarritt et al. | 493/471 |
| 4,539,239 | A | * | 9/1985 | Graves et al. | 428/43 |
| 5,140,872 | A | * | 8/1992 | Holliday et al. | 76/107.8 |
| 5,172,622 | A | * | 12/1992 | Sabin | 83/520 |
| 5,257,492 | A | * | 11/1993 | Watts | 53/430 |
| 5,778,748 | A | * | 7/1998 | Beijen | 83/529 |
| 5,895,682 | A | * | 4/1999 | Tsukioka | 426/383 |

(Continued)

FOREIGN PATENT DOCUMENTS

| | | |
|---|---|---|
| JP | 2000-190403 | 7/2000 |
| JP | 2002-224994 | 8/2002 |
| JP | 2008-023766 | 7/2008 |

*Primary Examiner* — Sean Michalski
(74) *Attorney, Agent, or Firm* — Kirschstein, et al.

(57) ABSTRACT

It is intended in an apparatus for successively making plastic bags that a plastic film 1 is cut by a Thomson blade 3 without making the Thomson blade 3 pressed with a large force. The Thomson blade 3 is brought into contact with the plastic film 1 on one of opposite sides of the plastic film 1 in a direction of thickness thereof while a rolling member 4 is brought into contact with the plastic film 1 and rolled and moved along the plastic film 1 and the Thomson blade 3 on the other side of the plastic film 1 in the direction of thickness thereof. The plastic film 1 is therefore sandwiched between and cut by the Thomson blade 3 and the rolling member 4 to successively make plastic bags.

13 Claims, 7 Drawing Sheets

A

B

(56) References Cited

U.S. PATENT DOCUMENTS

| | | | | |
|---|---|---|---|---|
| 5,979,308 | A * | 11/1999 | Kagi et al. | 101/3.1 |
| 8,074,568 | B2 * | 12/2011 | Paita et al. | 101/27 |
| 2005/0253324 | A1 * | 11/2005 | Corcoran et al. | 271/15 |
| 2009/0211468 | A1 * | 8/2009 | Steuer | 101/23 |
| 2012/0167789 | A1 * | 7/2012 | Angevine et al. | 101/24 |
| 2012/0234145 | A1 * | 9/2012 | Kandemir | 83/56 |
| 2013/0036883 | A1 * | 2/2013 | Gotz et al. | 83/23 |
| 2014/0260851 | A1 * | 9/2014 | Beaudry | 83/56 |
| 2014/0360329 | A1 * | 12/2014 | Lin | 83/206 |

* cited by examiner

PLASTIC BAG MAKING APPARATUS

TECHNICAL FIELD

The invention relates to an apparatus for successively making plastic bags.

BACKGROUND

For example, there has been known an apparatus for successively making plastic bags each of which comprises a shaped bag including curved opposite side edges, as disclosed in Japanese Patent Publication No. 3,344,958. In the apparatus, a plastic film is fed intermittently in a direction of length thereof. In general, a plurality of plastic films are superposed on each other and fed intermittently. The apparatus includes a Thomson blade which is moved toward and pressed against the plastic films and a receiver when the plastic films are stopped temporarily. The plastic films are therefore sandwiched between and cut by the Thomson blade and the receiver to successively make the plastic bags.

In the apparatus, a plurality of micro connecting portions are formed and spaced from each other along the cut line formed in the plastic films when the plastic films are cut. The micro connecting portions are called micro joints. The plastic films may be cut half in thickness, as disclosed in Japanese Laid-Open Patent Publication No. 2002-224994.

In this case, the plastic films are cut at once when the Thomson blade is pressed against the plastic films and the receiver. The apparatus is therefore problematic in that the Thomson blade has to be pressed with a large force. The force may reach a level of few tons.

In addition, the Thomson blade is mounted on a carriage. The carriage and the Thomson blade are moved by a drive. The apparatus is therefore problematic in that the drive has to have a large capacity to make the Thomson blade pressed with the large force. Furthermore, the Thomson blade has to be pressed against the plastic films and the receiver and uniformly through the cut portion of plastic films, otherwise the plastic films cannot be cut exactly. The Thomson blade may be damaged if being pressed locally and strongly. A parallelism is therefore required between the Thomson blade and the receiver. In this connection, the carriage and the receiver have to be kept from being bent when the Thomson blade is pressed with the large force, to maintain the parallelism between the Thomson blade and the receiver. The carriage and the receiver are therefore required to have rigidity, increasing weight and size. Consequently, the carriage has a large weight to be dangerous when being moved.

It is therefore an object of the invention to provide an apparatus for successively making plastic bags in which a plastic film is cut by a Thomson blade without making the Thomson blade pressed with a large force.

SUMMARY OF THE INVENTION

According to the invention, a plastic film is fed intermittently in a direction of length thereof. A Thomson blade is brought into contact with the plastic film on one of opposite sides of the plastic film in a direction of thickness thereof when the plastic film is stopped temporarily. A rolling member is brought into contact with the plastic film and rolled and moved along the plastic film and the Thomson blade on the other side of the plastic film in the direction of thickness thereof when the plastic film is stopped temporarily. The plastic film is therefore sandwiched between and cut by the Thomson blade and the rolling member to successively make plastic bags.

In a preferred embodiment, the rolling member is rolled and moved in a direction of width or length of plastic film.

It is preferable that the Thomson blade and the rolling member are pressed against the plastic film with a force of less than 60 kgf.

It is preferable that the Thomson blade and the rolling member are closed to each other at a distance of 0 to 0.06 mm.

In the embodiment, the rolling member comprises a roller.

An additional roller may be engaged with the roller. The roller and the additional roller are interposed between the Thomson blade and a base, the additional roller being engaged with the base. The base extends parallel to the Thomson blade. The roller and the additional roller are connected to a movable member which is moved by a drive. The additional roller is therefore rolled and moved along the base while the roller is rolled and moved along the plastic film and the Thomson blade.

The roller may be provided with a pinion and interposed between the Thomson blade and a base. The base is provided with a rack. The pinion is engaged with the rack. The base extends parallel to the Thomson blade. The base is moved by a drive so that the roller should be rotated, rolled and moved by the pinion and the rack.

The roller may be interposed between the Thomson blade and a base to be engaged with the base. The base extends parallel to the Thomson blade. The base is moved by a drive so that the roller should be rotated, rolled and moved by friction.

The roller may be engaged with a guide rail extending parallel to the Thomson blade. The roller is moved along the guide rail to be rolled along the plastic film and the Thomson blade.

The Thomson blade may be moved toward the plastic film to make the Thomson blade and the rolling member brought into contact with the plastic film.

The rolling member may be moved toward the plastic film to make the Thomson blade and the rolling member brought into contact with the plastic film.

Stops may be disposed on opposite sides of the Thomson blade in the direction of width or length of plastic film. The Thomson blade or the rolling member is moved toward the plastic film so that the stop and the rolling member should be engaged with each other to make the Thomson blade and the rolling member brought into contact with the plastic film.

Silicon or urethane rubbers may be disposed on opposite sides of the Thomson blade in the direction of width or length of plastic film. The silicon or urethane rubbers protrude beyond the Thomson blade toward the plastic film. The silicon or urethane rubber and the rolling member are engaged with each other when the Thomson blade or the rolling member is moved toward the plastic film so that the silicon or urethane rubber should be compressed and elastically deformed by the rolling member to make the Thomson blade and the rolling member brought into contact with the plastic film.

Auxiliary members may be disposed on opposite sides of the rolling member in the direction of length of plastic film. The auxiliary members are synchronized with the rolling member to be moved toward and engaged with the plastic film when the rolling member is moved toward the plastic film so that the plastic film should be displaced by the auxiliary members to a position corresponding to the Thomson blade.

BEST MODE TO CARRY OUT THE INVENTION

Embodiments of the invention are as follows.

Figure 1:
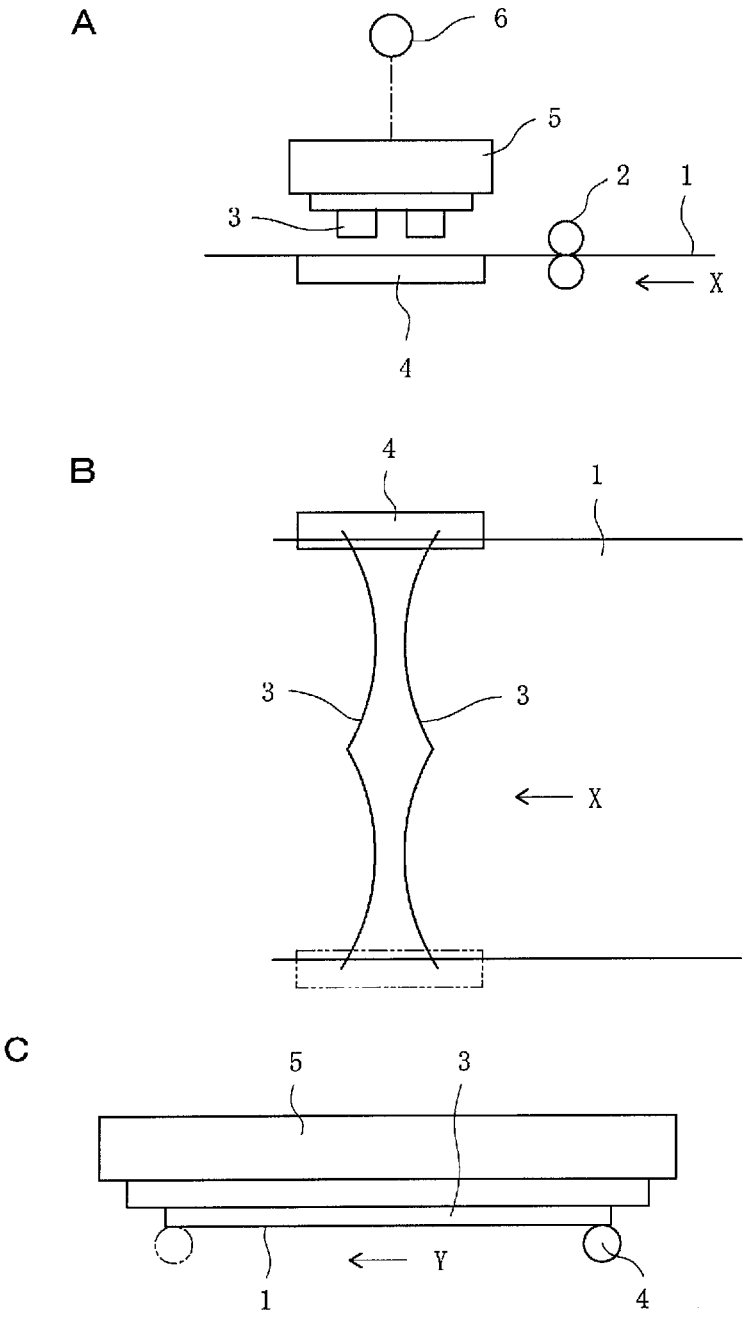
FIG. 1 is a side view (A) of a preferred embodiment of the invention, a plan view (B) of the Thomson blade and the roller of (A) and an elevational view (C) of the Thomson blade and the roller of (A).

Turning now to the drawings, FIG. 1 illustrates an apparatus for successively making plastic bags, according to the invention, in which a plastic film 1 is fed intermittently in a direction X of length thereof. In the embodiment, a plurality of plastic films 1 are superposed on each other and fed intermittently, as disclosed in Japanese Patent Publication No. 3,344,958. For example, the apparatus includes a feeding device comprising two rollers 2 to which the plastic films 1 are directed. The rollers 2 are rotated by a motor so that the plastic films 1 can be fed intermittently. The apparatus further includes heat seal devices by which the plastic films 1 are heat sealed with each other, as also disclosed in the Japanese patent publication.

In the apparatus, a Thomson blade 3 is brought into contact with the plastic films 1 on one of opposite sides of the plastic films 1 in a direction of thickness thereof after the plastic films 1 are heat sealed with each other and when the plastic films 1 are stopped temporarily whenever being fed intermittently. The Thomson blade 3 comprises two blades. In addition, a rolling member is brought into contact with the plastic films 1 and rolled and moved along the plastic films 1 and the Thomson blade 3 on the other side of the plastic films 1 in the direction of thickness thereof after the plastic films 1 are heat sealed with each other and when the plastic films 1 are stopped temporarily whenever being fed intermittently. The Thomson blade 3 extends in a direction Y of width of plastic films 1. The rolling member comprises a roller 4 extending in the direction X of length of plastic films 1 and rolled and moved in the direction Y of width of plastic films 1.

In the embodiment, the plastic films 1 are fed intermittently along a horizontal plane. The Thomson blade 3 is disposed on the upper side of the plastic films 1. In addition, the Thomson blade 3 is mounted on a carriage 5 to which a drive is connected. The carriage 5 and the Thomson blade 3 are moved downwardly by the drive when the plastic films 1 are stopped temporarily whenever being fed intermittently. For example, the drive comprises a motor 6 connected to the carriage 5 by means of a crank and a link. The crank is rotated by the motor 6 so that the carriage 5 and the Thomson blade 3 are moved downwardly by the link. The Thomson blade 3 is therefore moved toward the plastic films 1 and the roller 4 to be brought into contact with the plastic films 1 on the upper side of the plastic films 1.

The roller 4 is disposed below the plastic films 1. First and second standby positions are predetermined outwardly of the plastic films 1 in the direction Y of width thereof, the roller 4 being firstly held at the first standby position, as shown by solid line. The roller 4 has a length and includes an outer surface. In this connection, the truth is that the outer surface is tangent to the horizontal plane along which the plastic films 1 are fed intermittently. In addition, a drive is connected to the roller 4 so that the roller 4 can be moved by the drive in the direction Y of width of plastic films 1 to be brought into contact with the plastic films 1 on the lower side of the plastic films 1, after the Thomson blade 3 is brought into contact with the plastic films 1. The roller 4 is then rolled and moved along the plastic films 1 and the Thomson blade 3. The roller 4 is moved from the first standby position to reach the second standby position, as shown by dotted line.

It should therefore be understood that the plastic films 1 are sandwiched between and cut by the Thomson blade 3 and the roller 4, making the plastic bag.

The first and second standby positions are predetermined outwardly of the plastic films 1 in the direction Y of width thereof, as described previously. The roller 4 is therefore disposed away from the plastic film 1 when reaching the second standby position. The carriage 5 is then moved upwardly to the original position so that the Thomson blade 3 should be disposed away from the plastic films 1. The roller 4 is held at the second standby position while the plastic films 1 are fed again and intermittently. The Thomson blade 3 is moved toward the plastic films 1 and the roller 4 to be brought into contact with the plastic films 1 on the upper side of the plastic films 1 when the plastic films 1 are stopped temporarily. In addition, the roller 4 is moved by the drive to be brought into contact with the plastic films 1 on the lower side of the plastic films 1. The roller 4 is then rolled and moved along the plastic films 1 and the Thomson blade 3. The roller 4 is moved from the second standby position to reach the first standby position. The roller 4 is disposed away from the plastic films 1 again when reaching the first standby position.

The plastic films 1 are therefore cut again, making the plastic bag again. The steps are then performed alternately in a repetitive manner to successively make the plastic bags.

The plastic bag comprises a shaped bag including curved opposite side edges. The Thomson blade 3 is shaped to correspond to the shaped bag, as in the case of the Japanese patent publication.

In the apparatus, the roller 4 is rolled and moved along the plastic films 1 and the Thomson blade 3, to make the plastic films 1 cut. It should therefore be understood that the plastic films 1 are cut not at once but progressively. In this case, a concentrated load works on a point of contact between the roller 4 and the plastic films 1, the plastic films 1 being cut by the concentrated load. As a result, a large force has not to be applied to the Thomson blade 3 to make the Thomson blade 3 and the roller 4 pressed against the plastic films 1. The plastic films 1 can be cut by the Thomson blade 3 and the roller 4 without making the Thomson blade 3 and the roller 4 pressed with the large force. The Thomson blade 3 and the roller 4 are pressed with a small force.

In this connection, the motor 6 has not to have a large capacity by reason that the Thomson blade 3 and the roller 4 have not to be pressed with the large force. The carriage 5 is therefore free from being bent by the large force. As a result, the Thomson blade 3 and the roller 4 can be pressed uniformly through the cut portion of plastic films 1, to make the plastic films 1 cut exactly. The carriage 5 is not required to have rigidity, not increasing weight and size. There is no problem of the carriage 5 having a large weight to be dangerous when being moved.

In the apparatus, it is confirmed by test that the plastic films 1 are cut by the Thomson blade 3 and the roller 4 which are pressed against the plastic films 1 with a force of less than 60 kgf. In the embodiment, the Thomson blade 3 and the roller 4 are therefore pressed against the plastic films 1 with the force of less than 60 kgf.

In the apparatus, it is also confirmed by test that the plastic films 1 are cut by the Thomson blade 3 and the roller 4 which are closed to each other at a distance of 0 to 0.06 mm. In the embodiment, the Thomson blade 3 and the roller 4 are therefore closed to each other at the distance of 0 to 0.06 mm.

Figure 2:
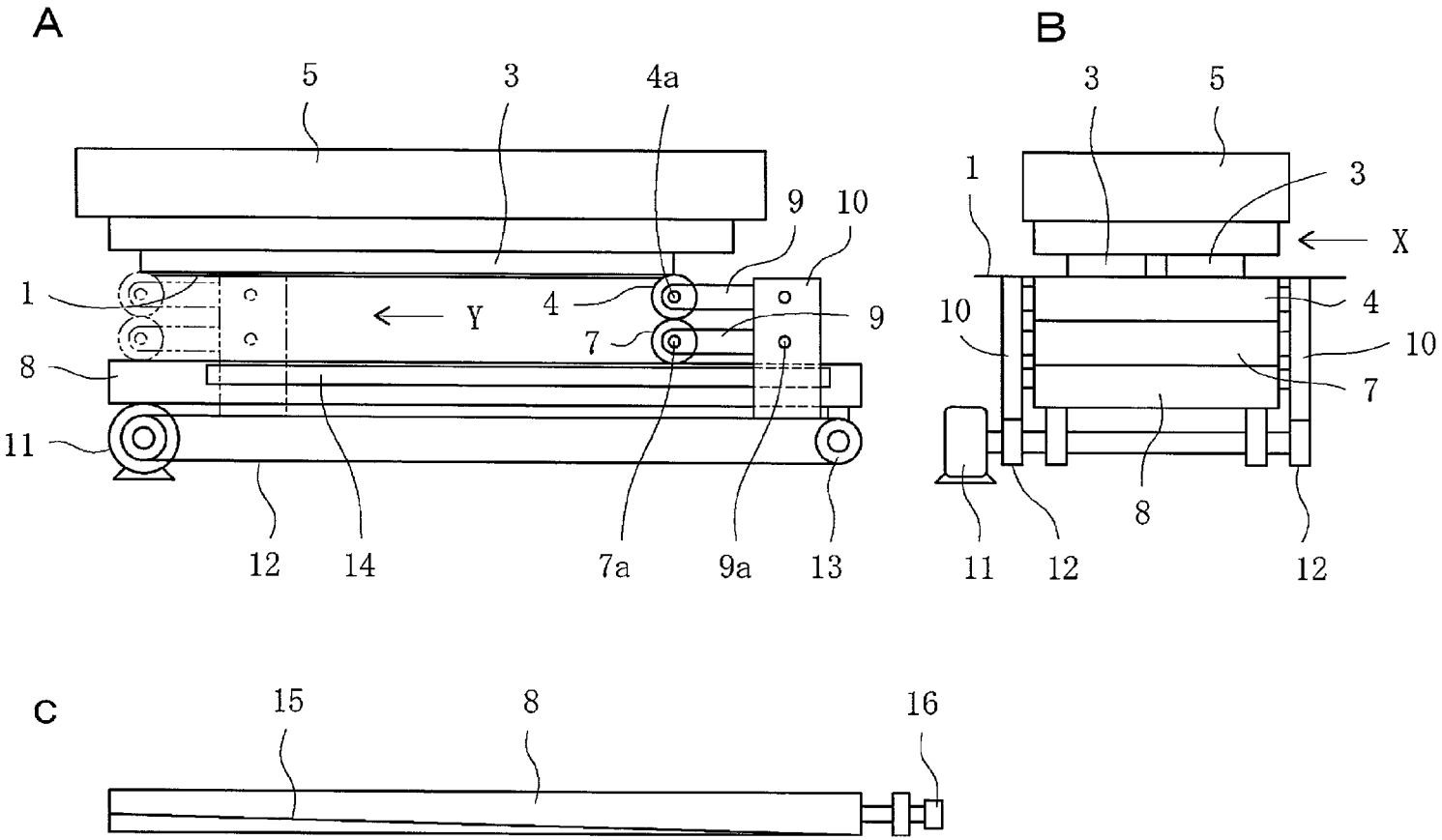
FIG. 2 is an elevational view (A) of another embodiment, a side view (B) of the Thomson blade and the roller of (A) and an explanatory view (C) of the positional adjustment system for the base of (A).

In another embodiment of FIG. 2, an additional roller 7 is engaged with the roller 4. The roller 4 and the additional roller 7 are interposed between the Thomson blade 3 and a base 8, the additional roller 7 being engaged with the base 8. The roller 4 is disposed on the upper side of the additional roller 7 while the base 8 is disposed on the lower side of the additional roller 7. The base 8 extends parallel to the Thomson blade 3. In addition, the roller 4 and the additional roller 7 are connected to links 9 and a movable member 10 which is moved by a drive. For example, the roller 4 and the additional roller 7 are connected to the links 9 by means of pins 4*a* and 7*a* while the links 9 are connected to the movable member 10 by means of pins 9*a*. The roller 4 and the additional roller 7 extend in the direction X of length of plastic films 1 for rotation about the pins 4*a* and 7*a*. The links 9 extend in the direction Y of width of plastic films 1 for swinging movement about the pins 9*a*. The drive comprises a motor 11 connected to the movable member 10 by means of a timing belt 12 and timing pulleys 13. The base 8 is provided with a linear guide 14 by which the movable member 10 is guided for movement along the linear guide 14. The linear guide 14 also extends in the direction Y of width of plastic films 1.

In the embodiment, the roller 4 and the additional roller 7 are subjected to gravity so that the roller 4 can be engaged with and supported by the additional roller 7 engaged with and supported by the base 8. The movable member 10 is moved by the motor 11, the timing belt 12 and the timing pulleys 13 after the Thomson blade 3 is brought into contact with the plastic films 1. The movable member 10 is moved along the linear guide 14 in the direction Y of width of plastic films 1, the roller 4 and the additional roller 7 being also moved in the direction Y. The additional roller 7 is therefore rolled and moved along the base 8 and rotated in a direction. The roller 4 is rotated in the reverse direction in response to the additional roller 7 to be rolled and moved along the plastic films 1 and the Thomson blade 3. The roller 4 is moved from the first standby position to reach the second standby position and then moved from the second standby position to reach the first standby position, as in the case of the embodiment of FIG. 1.

In addition, in the embodiment, the base 8 is provided with a positional adjustment system by which the base 8 is moved toward and away from the plastic films 1 for adjustment of position. For example, the adjustment system is a type of tapered surface in which the base 8 is engaged with a tapered surface 15 and moved by a screw 16 to slide along the tapered surface 15. The base 8 is therefore moved by the tapered surface 15 toward and away from the plastic films 1 for adjustment of position. The base 8 is moved to and disposed at a position predetermined to make the Thomson blade 3 and the roller 4 pressed against the plastic films 1 with the force of less than 60 kgf. The Thomson blade 3 and the roller 4 may be closed to each other at the distance of 0 to 0.06 mm. It should therefore be understood that the Thomson blade 3 and the roller 4 are pressed with a small force.

In the positional adjustment system of FIG. 2, the base 8 may be engaged with the tapered surface 15 by gravity. The system may include a spring working on the base 8 to make the base 8 kept being engaged with the tapered surface 15.

Figure 3:
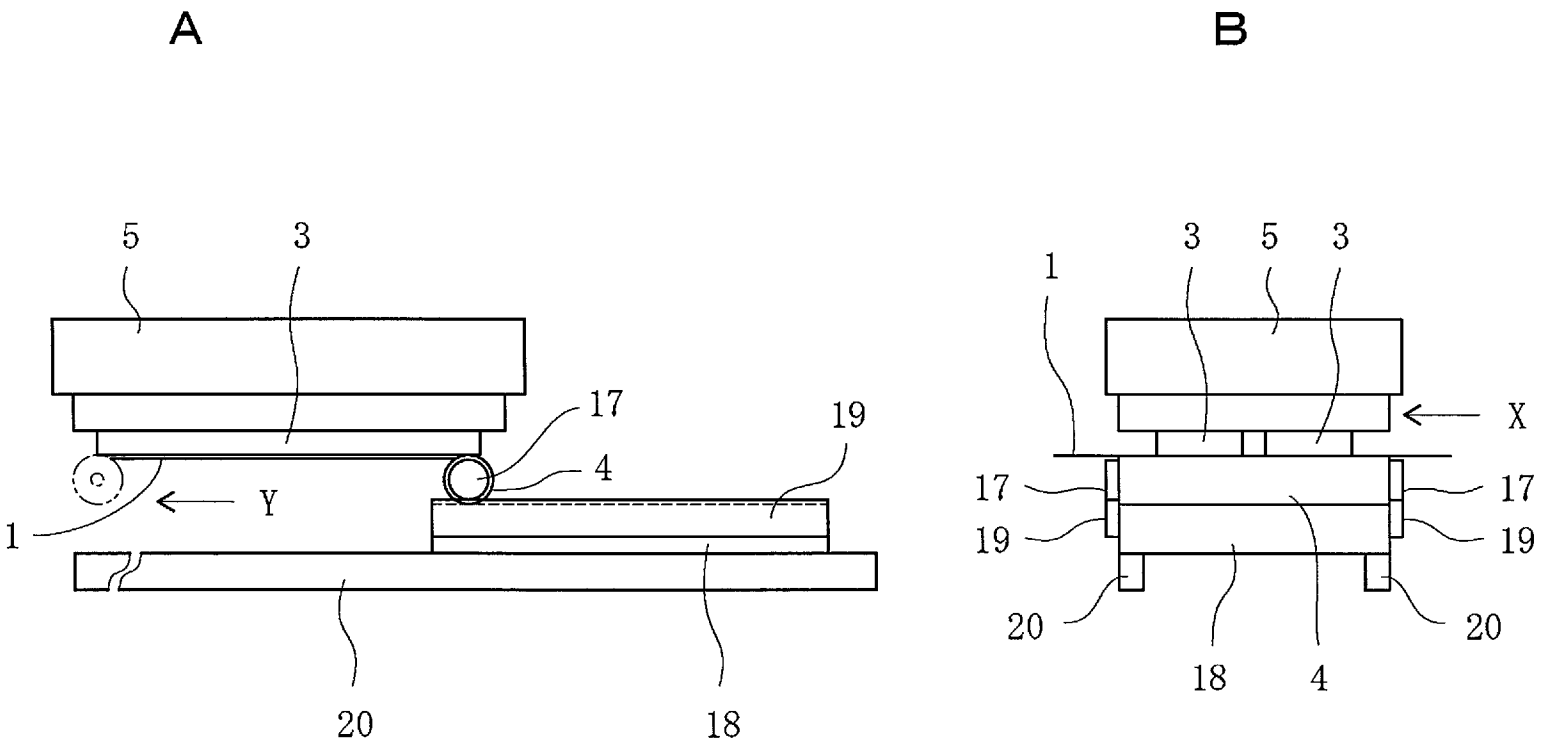
FIG. 3 is an elevational view (A) of another embodiment and a side view (B) of the Thomson blade and the roller of (A).

In another embodiment of FIG. 3, the roller 4 is provided with a pinion 17 and interposed between the Thomson blade 3 and a base 18 to be engaged with and supported by the base 18. The base 18 is provided with a rack 19. The pinion 17 is engaged with the rack 19. The base 18 extends parallel to the Thomson blade 3. The base 18 is moved by a drive so that the roller 4 should be rotated, rolled and moved by the pinion 17 and the rack 19 after the Thomson blade 3 is brought into contact with the plastic films 1. The base 18 is moved along a guide rail 20. The plastic films 1 are therefore cut by the Thomson blade 3 and the roller 4.

The roller 4 may be interposed between the Thomson blade 3 and the base 18 to be engaged with the base 18. The base 18 extends parallel to the Thomson blade 3. The base 18 is moved by a drive so that the roller 4 should be rotated, rolled and moved by friction.

Figure 4:
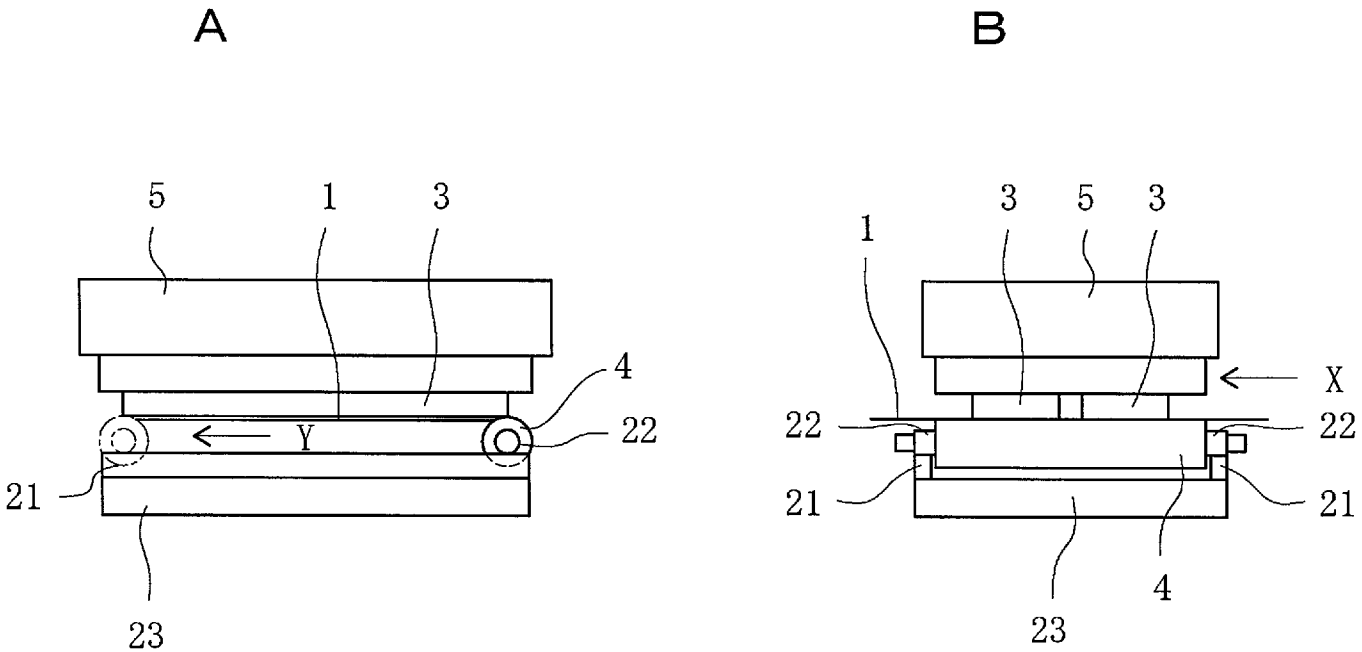
FIG. 4 is an elevational view (A) of another embodiment and a side view (B) of the Thomson blade and the roller of (A).

In another embodiment of FIG. 4, the roller 4 is engaged with and supported by a guide rail 21 extending parallel to the Thomson blade 3. For example, the roller 4 includes trunnions protruding from the opposite ends thereof and provided with bearings 22. A base 23 is provided with a pair of guide rails 21 extending parallel to the Thomson blade 3. The bearings 22 are engaged with and supported by the guide rails 21. The Thomson blade 3 is moved toward and brought into contact with the plastic films 1. The roller 4 is then moved along the guide rails 21 to be brought into contact with the plastic film 1 and rolled along the plastic films 1 and the Thomson blade 3. The plastic films 1 are cut by the Thomson blade 3 and the roller 4.

In the embodiments of FIGS. 3 and 4, the base 18 and the guide rail 21 are moved by the positional adjustment system toward or away from the plastic films 1 for adjustment of position to make the Thomson blade 3 pressed with a small force, as in the case of the embodiment of FIG. 2.

In each of the embodiments, the roller 4 may be moved not in the direction Y of width but in the direction X of length of plastic films 1 to make the plastic films 1 cut by the Thomson blade 3 and the roller 4.

Figure 5:
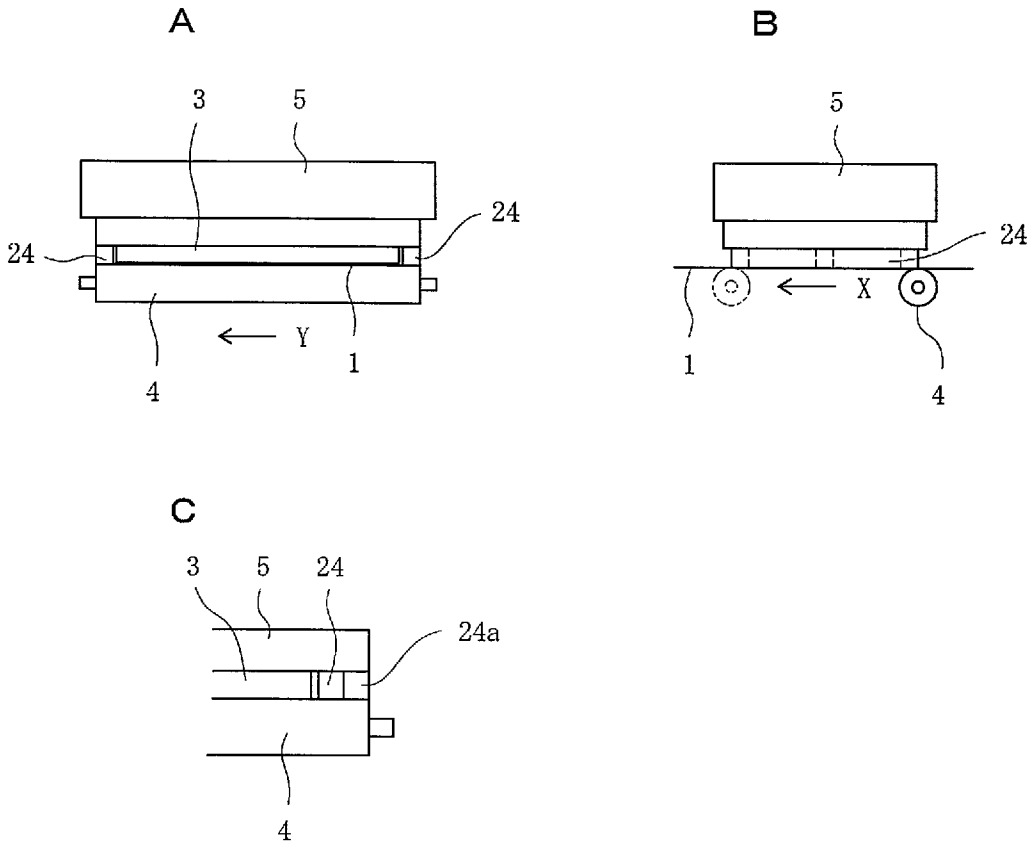
FIG. 5 is an elevational view (A) of another embodiment, a side view (B) of the Thomson blade and the roller of (A) and an explanatory view (C) of another embodiment.

In another embodiment of FIG. 5, stops 24 are disposed on opposite sides of the Thomson blade 3 in the direction Y of width of plastic films 1. The stops 24 are moved by a positional adjustment system toward or away from the plastic films 1 to a position corresponding to the Thomson blade 3. The adjustment system may comprise the type of tapered surface, as in the case of the embodiment of FIG. 2. The Thomson blade 3 extends in the direction Y of width of plastic films 1. The roller 4 also extends in the direction Y of width of plastic films 1. The Thomson blade 3 is moved toward the plastic films 1 so that the stop 24 and the roller 4 should be engaged with each other to make the Thomson blade 3 and the roller 4 brought into contact with the plastic films 1. The roller 4 is then rolled and moved in the direction X of length of plastic films 1. The Thomson blade 3 and the roller 4 can therefore be pressed with a small force, the plastic films 1 being cut exactly.

The stops 24 may be disposed on opposite sides of the Thomson blade 3 in the direction X of length of plastic films 1. The stops 24 are moved by a positional adjustment system toward or away from the plastic films 1 to a position corresponding to the Thomson blade 3. The Thomson blade 3 is moved toward the plastic films 1 so that the stops 24 and the roller 4 should be engaged with each other to make the Thomson blade 3 and the roller 4 brought into contact with the plastic films 1. The roller 4 is then rolled and moved in the direction Y of width of plastic films 1.

The roller 4 is made of metal. The stops 24 are also made of metal. It is therefore preferable to absorb an impact with cushions when the stops 24 and the roller 4 are engaged with each other. For example, silicon or urethane rubbers 24*a* are used as the cushions and disposed on opposite sides of the Thomson blade 3 in the direction Y of width of plastic films 1, in addition to the stops 24. The silicon or urethane rubbers 24*a* may be disposed on opposite sides of the Thomson blade 3 in the direction X of length of plastic films 1. The silicon or urethane rubbers 24*a* comprise sponge rubbers and protrude beyond the Thomson blade 3 toward the plastic films 1. The silicon or urethane rubber 24*a* and the roller 4 are engaged with each other when the Thomson blade 3 is moved toward the plastic films 1 so that the silicon or urethane rubbers 24*a* should be compressed and elastically deformed by the roller 4 to make the Thomson blade 3 and the roller 4 brought into contact with the plastic films 1 and absorb the impact with the silicon or urethane rubber 24*a*.

In each of the embodiments, the Thomson blade 3 has not always to be moved toward the plastic films 1. Alternatively, the roller 4 may be moved toward the plastic films 1 to make the Thomson blade 3 and the roller 4 brought into contact with the plastic films 1.

Figure 6:
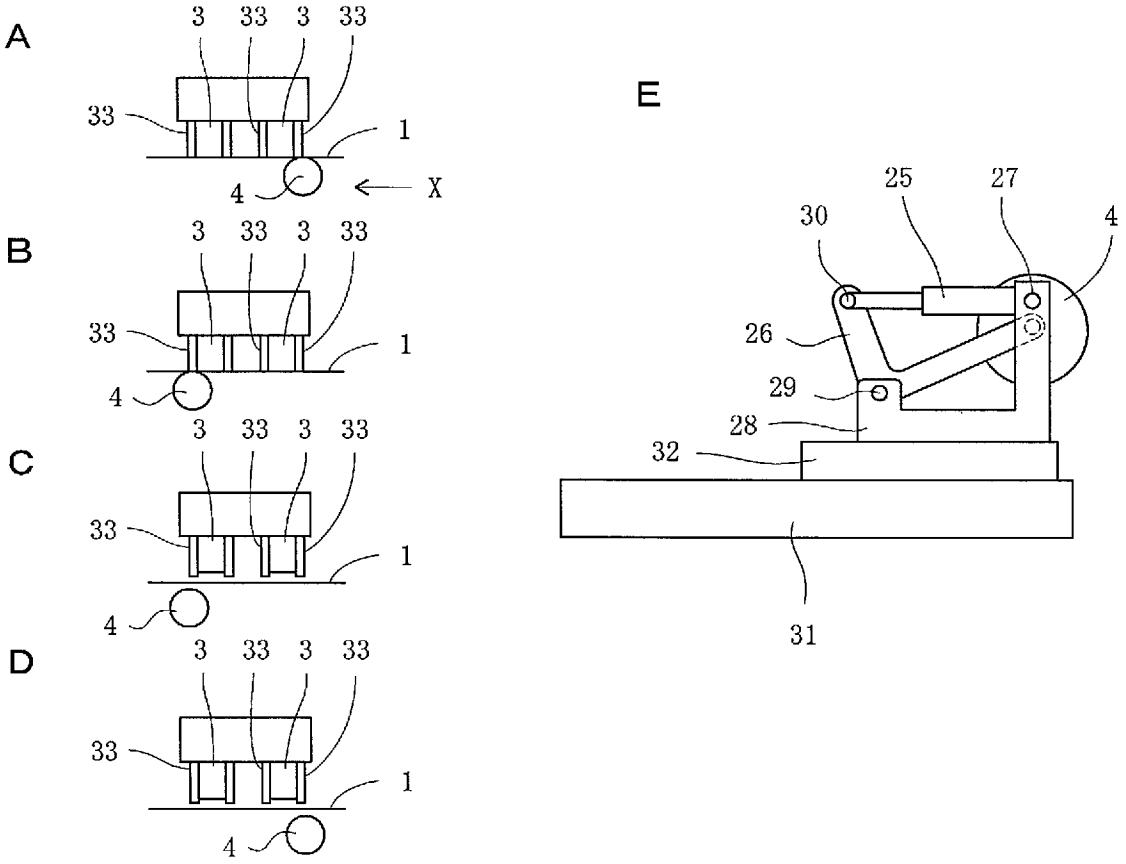
FIG. 6 is a side view (A) of another embodiment, a side view (B) of the step next to (A), a side view (C) of the step next to (B), a side view (D) of the step next to (C) and an explanatory view (E) of the drive for the roller of (A).

In another embodiment of FIG. 6, a cylinder 25 and a bell crank 26 are used as the drive for the roller 4. In the drive, a pin 27 is also used along with a carriage 28 and a pin 29. The cylinder 25 is connected to and supported by the carriage 28 by means of the pin 27. The bell crank 26 is connected to and supported by the carriage 28 by means of the pin 29. The bell crank 26 includes opposite ends at one of which the roller 4 is supported. The cylinder 25 is connected to the bell crank 26 by means of a pin 30 at the other end of the bell crank 26. The drive further includes a cylinder 31, the carriage 28 being mounted on and supported by a base 32 which is mounted on and supported by the cylinder 31. The cylinder 31 is provided with a linear guide. The base 32 is guided by the linear guide for movement along the linear guide. The roller 4 extends in the direction Y of width of plastic films 1 while the cylinder 31 and the linear guide extend in the direction X of length of plastic films 1.

In addition, in the embodiment of FIG. 6, silicon or urethane rubbers 33 are disposed on opposite sides of the Thomson blade 3 in the direction X of length of plastic films 1. The silicon or urethane rubbers 33 comprise sponge rubbers and protrude beyond the Thomson blade 3 toward the plastic films 1.

The bell crank 26 is moved swingingly by the cylinder 25 counterclockwise about the pin 29 when the plastic films 1 are stopped temporarily whenever being fed intermittently. The roller 4 is therefore lifted by the bell crank 26 to be moved upwardly toward the plastic films 1. The silicon or urethane rubber 33, the plastic films 1 and the roller 4 are engaged with each other on one of the opposite sides of the Thomson blade 3. The silicon or urethane rubbers 33 are compressed and elastically deformed by the roller 4, to make the Thomson blade 3 and the roller 4 brought into contact with the plastic film 1 (FIG. 6 A).

The carriage 28 and the base 32 are then moved by the cylinder 31 so that the roller 4 should be rolled and moved along the plastic films 1 and the Thomson blade 3. The base 32 is moved along the linear guide. The roller 4 is therefore moved in the direction X of length of plastic films 1 to reach a position predetermined on the other side of the Thomson blade 3, the plastic films 1 being cut by the Thomson blade 3 and the roller 4. The silicon or urethane rubber 33, the plastic films 1 and the roller 4 are engaged with each other so that the silicon or urethane rubber 33 should be compressed and elastically deformed by the roller 4 (FIG. 6 B).

The bell crank 26 is then moved swingingly by the cylinder 25 clockwise about the pin 29. The roller 4 is therefore moved downward and disposed away from the plastic films 1 so that the silicon or urethane rubbers 33 should be restored to the original condition. The plastic films 1 are therefore pushed downward by the silicon or urethane rubbers 33 to be peeled off the Thomson blade 3 (FIG. 6C).

The carriage 28 and the base 32 are then moved by the cylinder 31 so that the roller 4 should be returned to and held at the original position (FIG. 6 D).

In addition, in the embodiment of FIG. 6, the carriage 28 is connected to the base 32 by means of a vertical shaft to be moved swingingly about the shaft. This arrangement can make the roller 4 inclined with respect to the Thomson blade 3 by the carriage 28 moved swingingly to improve the cutting function of the Thomson blade 3.

In the embodiment of FIG. 6, stops may be disposed on opposite sides of the Thomson blade 3 in the direction Y of width of plastic films 1. The roller 4 is moved toward the plastic films 1 so that the stops and the roller 4 should be engaged with each other to make the Thomson blade 3 and the roller 4 brought into contact with the plastic films 1. In addition, cushions may be disposed on opposite sides of the Thomson blade 3 in the direction Y of width of plastic films 1, to absorb an impact with the cushions when the stops and the roller 4 are engaged with each other.

In the embodiment of FIG. 6, the roller 4 may be rolled and moved not in the direction X of length but in the direction Y of width of plastic films 1, to make the plastic films 1 cut by the Thomson blade 3 and the roller 4. Stops may be disposed on opposite sides of the Thomson blade 3 in the direction X of length of plastic films 1. The roller 4 is moved toward the plastic films 1 so that the stops and the roller 4 should be engaged with the plastic films 1. In addition, cushions may be disposed on opposite sides of the Thomson blade 3 in the direction X of length of plastic films 1.

In the embodiment of FIG. 6, the Thomson blade 3 may be moved toward the plastic films 1, to make the silicon or urethane rubbers 33 and the roller 4 engaged with each other.

Silicon or urethane rubbers may be disposed on opposite sides of the Thomson blade 3 not in the direction X of length but in the direction Y of width of plastic films 1 to protrude beyond the Thomson blade 3 toward the plastic films 1. The silicon or urethane rubbers and the roller 4 are engaged with each other when the Thomson blade 3 or the roller 4 is moved toward the plastic films 1 so that the silicon or urethane rubbers should be compressed and elastically deformed by the roller 4 to make the Thomson blade 3 and the roller 4 brought into contact with the plastic films 1.

Figure 7:
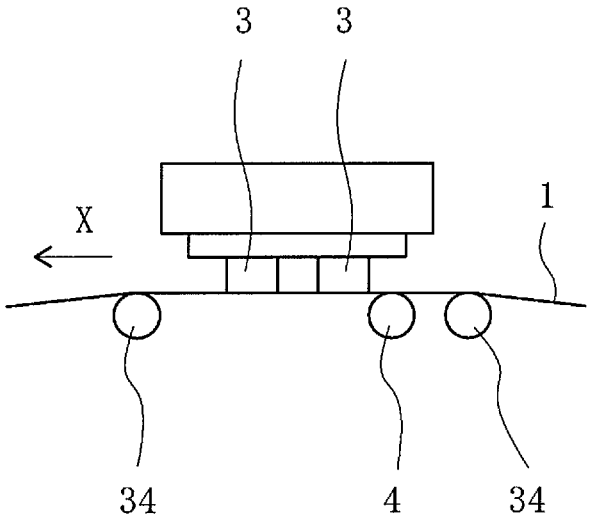
FIG. 7 is a side view of another embodiment.

In another embodiment of FIG. 7, auxiliary members 34 are disposed on opposite sides of the roller 4 in the direction X of length of plastic films. The auxiliary members 34 are synchronized with the roller 4 to be moved toward and engaged with the plastic films 1 when the roller 4 is moved toward the plastic films 1 so that the plastic films 1 should be displaced by the auxiliary members 34 to a position corresponding to the Thomson blade 3. The auxiliary members 34 comprise guide rollers.

The Thomson blade 3 and the roller 4 can therefore be brought into contact with the plastic films 1 exactly. The roller 4 and the auxiliary members 34 are then disposed away from the plastic films 1 after the plastic films 1 are cut. The plastic films 1 are pulled downward by tension to be peeled off the Thomson blade 3. The plastic films 1 are then fed again and intermittently.

Figure 8:
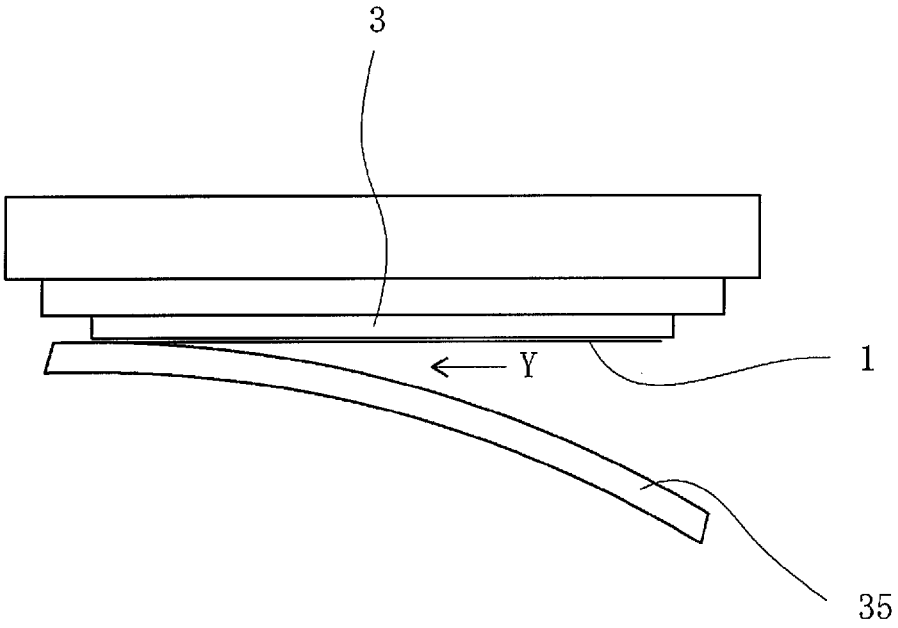
FIG. 8 is an elevational view of another embodiment.

In another embodiment of FIG. 8, the rolling member comprises not the roller 4 but an arced member 35. The arced member 35 is rolled and moved along the plastic films 1 and the Thomson blade 3 to make the plastic films 1 cut by the Thomson blade 3 and the arced member 35.

In each of the embodiments, a plurality of micro depressions may be formed and spaced from each other along the cutting edge of Thomson blade 3 so that a plurality of micro connecting portions should be formed and spaced from each other along the cut line formed in the plastic films 1 when the plastic films 1 are cut, as in the case of the apparatus of the Japanese Patent. The micro connecting portions are called micro joints. The plastic films 1 may be cut half in thickness, as in the case of the apparatus of Japanese Laid-Open Patent Publication No. 2002-224994.

What is claimed is:

1. An apparatus for successively making plastic bags comprising:

a feeding device by which a plastic film is fed intermittently in a direction of length thereof;

a Thomson blade for contacting the plastic film on one of opposite sides of the plastic film in a direction of thickness thereof when the plastic film is stopped temporarily; and a rolling member for contacting the plastic film and rolled and moved along the plastic film and the Thomson blade in a direction of width of the plastic film on the other side of the plastic film when the plastic film is stopped temporarily, the plastic film being sandwiched between and cut by the Thomson blade and the rolling member to successively make the plastic bags.

2. The apparatus as set forth in claim 1 wherein the Thomson blade and the rolling member are pressed against the plastic film with a force of less than 60 kgf.

3. The apparatus as set forth in claim 1 wherein the Thomson blade and the rolling member are closed to each other at a distance of 0 to 0.06 mm.

4. The apparatus as set forth in claim 1 wherein the rolling member comprises a roller.

5. The apparatus as set forth in claim 4 further comprising an additional roller engaged with the roller, the roller and the additional roller being interposed between the Thomson blade and a base, the additional roller being engaged with the base, the base extending parallel to the Thomson blade, the roller and the additional roller being connected to a movable member which is moved by a drive, the additional roller being rolled and moved along the base while the roller is rolled and moved along the plastic film and the Thomson blade.

6. The apparatus as set forth in claim 4 wherein the roller is provided with a pinion and interposed between the Thomson blade and a base, the base being provided with a rack, the pinion being engaged with the rack, the base extending parallel to the Thomson blade, the base being moved by a drive so that the roller is rotated, rolled and moved by the pinion and the rack.

7. The apparatus as set forth in claim 4 wherein the roller is interposed between the Thomson blade and a base to be engaged with the base, the base extending parallel to the Thomson blade, the base being moved by a drive so that the roller is rotated, rolled and moved by friction.

8. The apparatus as set forth in claim 4 wherein the roller is engaged with a guide rail extending parallel to the Thomson blade, the roller being moved along the guide rail to be rolled along the plastic film and the Thomson blade.

9. The apparatus as set forth in claim 1 wherein the Thomson blade is moved toward the plastic film to contact the Thomson blade and the rolling member with the plastic film.

10. The apparatus as set forth in claim 1 wherein the rolling member is moved toward the plastic film to contact the Thomson blade and the rolling member with the plastic film.

11. The apparatus as set forth in claim 9 further comprising stops disposed on opposite sides of the Thomson blade in a direction of width of the plastic film, the Thomson blade or the rolling member being moved toward the plastic film so that the stops and the rolling member are engaged with each other, the Thomson blade and the rolling member contacting the plastic film.

12. The apparatus as set forth in claim 9 further comprising silicon or urethane rubbers disposed on opposite sides of the Thomson blade in a direction of width of the plastic film, the silicon or urethane rubbers protruding beyond the Thomson blade toward the plastic film, the silicon or urethane rubbers and the rolling member being engaged with each other when the Thomson blade or the rolling member is moved toward the plastic film so that the silicon or urethane rubbers are compressed and elastically deformed by the rolling member to contact the Thomson blade and the rolling member with the plastic film.

13. The apparatus as set forth in claim 10 further comprising auxiliary members disposed on opposite sides of the rolling member in a direction of length of the plastic film, the auxiliary members being synchronized with the rolling member to be moved toward and engaged with the plastic film when the rolling member is moved toward the plastic film so that the plastic film is displaced by the auxiliary members to a position corresponding to the Thomson blade.

* * * * *